US006826875B2

(12) United States Patent
Hasse

(10) Patent No.: US 6,826,875 B2
(45) Date of Patent: Dec. 7, 2004

(54) TEMPORARY STAIRWAY RAIL AND BALUSTER SUPPORT

(76) Inventor: Stephen J. Hasse, 816 Ocean Rd., Point Pleasant, NJ (US) 08742

( * ) Notice: Subject to any disclaimer, the term of this patent is extended or adjusted under 35 U.S.C. 154(b) by 35 days.

(21) Appl. No.: 10/454,085

(22) Filed: Jun. 5, 2003

(65) Prior Publication Data

US 2004/0006946 A1 Jan. 15, 2004

Related U.S. Application Data

(60) Provisional application No. 60/387,753, filed on Jun. 11, 2002.

(51) Int. Cl.[7] ..... E04F 11/00

(52) U.S. Cl. ..... 52/188; 52/184; 52/287.1; 52/182

(58) Field of Search ..... 52/188, 179, 184, 52/182, 287.1, 288.1

(56) References Cited

U.S. PATENT DOCUMENTS

2004/0010987 A1 * 1/2004 Lanphier ..... 52/182

* cited by examiner

*Primary Examiner*—Carl D. Friedman
*Assistant Examiner*—Jennifer I. Thissell
(74) *Attorney, Agent, or Firm*—Clifford G. Frayne

(57) ABSTRACT

A temporary stairway rail support for erecting a temporary stairway rail for use and safety during the construction phase of the building, the temporary stairway rail support having planar base member in contact with a portion of the stair tread, an L-shaped open stringer/riser engaging portion formed of two planar adjacent, depending side walls having formed therein a nosing/tread edge engaging portion which is C-shaped in cross section and engages the lower face of the nosing, the outer edge of the nosing and a portion of the tread at the corner of a step above an open stringer, and a tubular upright member secured to the upper surface of the planar base member portion, said tubular upright member dimensioned to support a temporary newel post or temporary baluster upon which a temporary hand rail can be secured.

6 Claims, 5 Drawing Sheets

TEMPORARY STAIRWAY RAIL AND BALUSTER SUPPORT

RELATED APPLICATIONS

Applicant claims the benefit of provisional application Ser. No. 60/387,753, filed Jun. 11, 2002.

BACKGROUND OF THE INVENTION

1. Field of the Invention

The present invention relates to railings and in particular, to a temporary rail and baluster support for stairways or walkways for use during the construction process.

2. Description of the Prior Art

During the course of building construction, various tradesmen may be working simultaneously within the building in their particular trade. These could be plumbers, electricians, carpenters, HVAC, etc. In a multi-story building, such as two story home, the tradesmen need access to all portions of the building in order to complete their particular tasks. Therefore the carpenters must construct the stairways and open hallways where appropriate before the electricians, plumbers and other tradesmen can properly perform their work. Typically, the finishing woodwork, and particularly the finished stair rail and balusters, would not be put in place until all of the trade work had been completed in order to prevent its being damaged during the construction phase of the house. Contractors normally do not bother to put any railing or balusters up during the construction process, however, building codes and government standards are increasingly enforcing regulations that require that a railing be constructed as soon as the stairs or the open walkways or hallways have been completed to the point that they are being used by the tradesmen.

This presents some difficulty, particularly in the high end market for homes where the stairways and hallways are constructed of expensive and/or premium woods which would be disfigured by the placement of a temporary railing system. In other words, the fastening means used for the temporary rail system may not coincide with the fastening means for the final railing to be associated with the stairway or open hallway and this would therefore detract from the hallway or stairway and would be unacceptable to the home owner who had contracted for an expensive and/or premium wood for the stairway or hallway.

Applicant's invention provides a temporary rail and baluster support so that the temporary railing system can be positioned and secured during the construction phase and is capable of being positioned such that the securing apertures formed by the fastening means are not visible once the temporary rail support is removed in that the apertures coincide with the fastening means used to secure the finished baluster.

OBJECTS OF THE INVENTION

An object of the present invention is to provide for a novel temporary stairway rail support for erecting a temporary stairway rail during construction.

A further object of the present invention is to provide for a novel temporary stairway rail support which can be secured without marring or damaging the finished, permanent wooden stairway.

A still further object of the present invention is to provide for a novel temporary stairway rail support which can be secured without making additional bores or apertures in the tread.

SUMMARY OF THE INVENTION

A temporary stairway rail support for erecting a temporary stairway rail for use and safety during the construction phase of the building, the temporary stairway rail support having planar base member in contact with a portion of the stair tread, a depending L-shaped open stringer/riser engaging portion formed of two planar side walls having formed therein a nosing/tread edge engaging portion which is C-shaped in cross section and engages the lower face of the nosing, the outer edge of the nosing and a portion of the tread at the corner of a step above an open stringer, and a tubular upright member secured to the upper surface of the planar base member portion, said tubular upright member dimensioned to support a newel post or baluster upon which a temporary hand rail can be secured. The temporary stairway rail support can be secured to the stairs by frictional engagement or a fastening means.

BRIEF DESCRIPTION OF THE DRAWINGS

These and other objects of the present invention will become apparent particularly when taken in light of the following illustrations wherein.

DETAILED DESCRIPTION OF THE DRAWINGS

Figure 1:
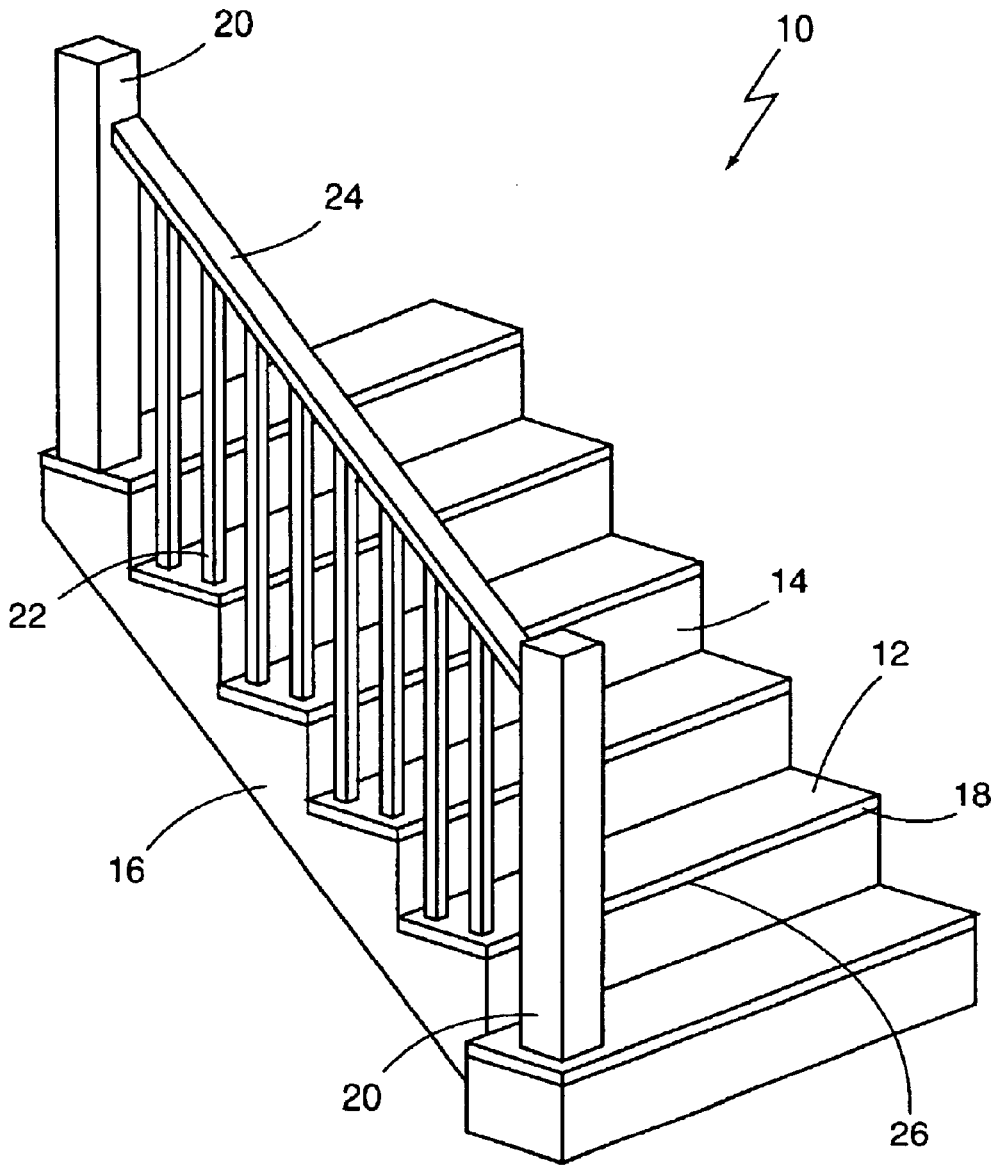
FIG. 1 is a perspective view of a typical stairway having a left handed open stringer.

FIG. 1 illustrates a typical finished staircase 10 which might be found in most homes. It consists of a plurality of horizontal tread members 12 supported on a plurality of stringers 16 and a plurality of vertical riser members 14 positioned on the stringers between each successive tread member. The side of the stairway in which the permanent railing would be installed, would be finished with an open stringer 16. Each of the tread members 12 overlap the riser 14 and overlap the open stringer 16, the overlap of the riser being referred to as the nosing 18. A newel post 20 is secured to the first or lowest most tread member 12 of the stairway and to the top step of the run of the stairway which would be the second floor if it were a straight stairway, or possible an intermediate landing if the stairway were L-shaped. Between the newels on each tread member there would be secured a plurality of balusters 22 and the hand rail 24 would be supported by the upper ends of the newels and the balusters. Also, in a finished stairway of the type described, there would be positioned under the nosing a finished cove molding piece 26 which would extend across the riser 14 and along the tread member 12 beneath the overhang of the tread.

As stated, in order to complete construction, the tradesmen must have access to the second floor. Therefore it is a necessity that the stairway, including the stringers, tread members and riser members, be positioned as soon as possible. Since large and bulky items are moved up the stairway to gain access to the second floor, the hand rail, newel post and balusters are normally not installed until the project is almost completed. Due to the government regulations, there is a need to now install a temporary stairway handrail in order to comply with regulations, yet the installation be flexible enough that large and bulky items can still be moved from the first floor to the second floor and permanent damage is not done to the tread member, riser member, and open stringer.

Figure 2:
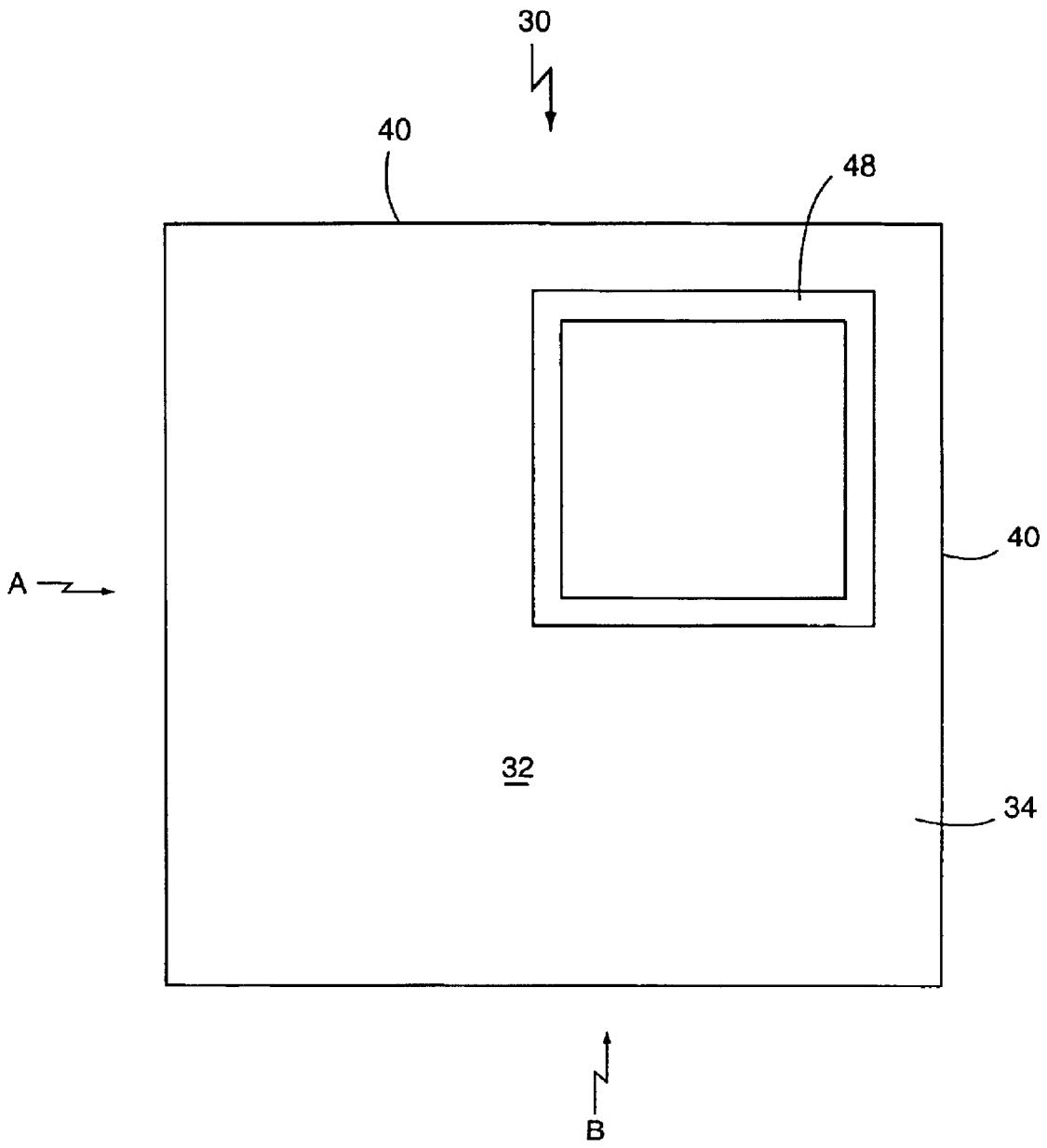
FIG. 2 is a top view of the temporary stairway rail and baluster support of the present invention.
Figure 3:
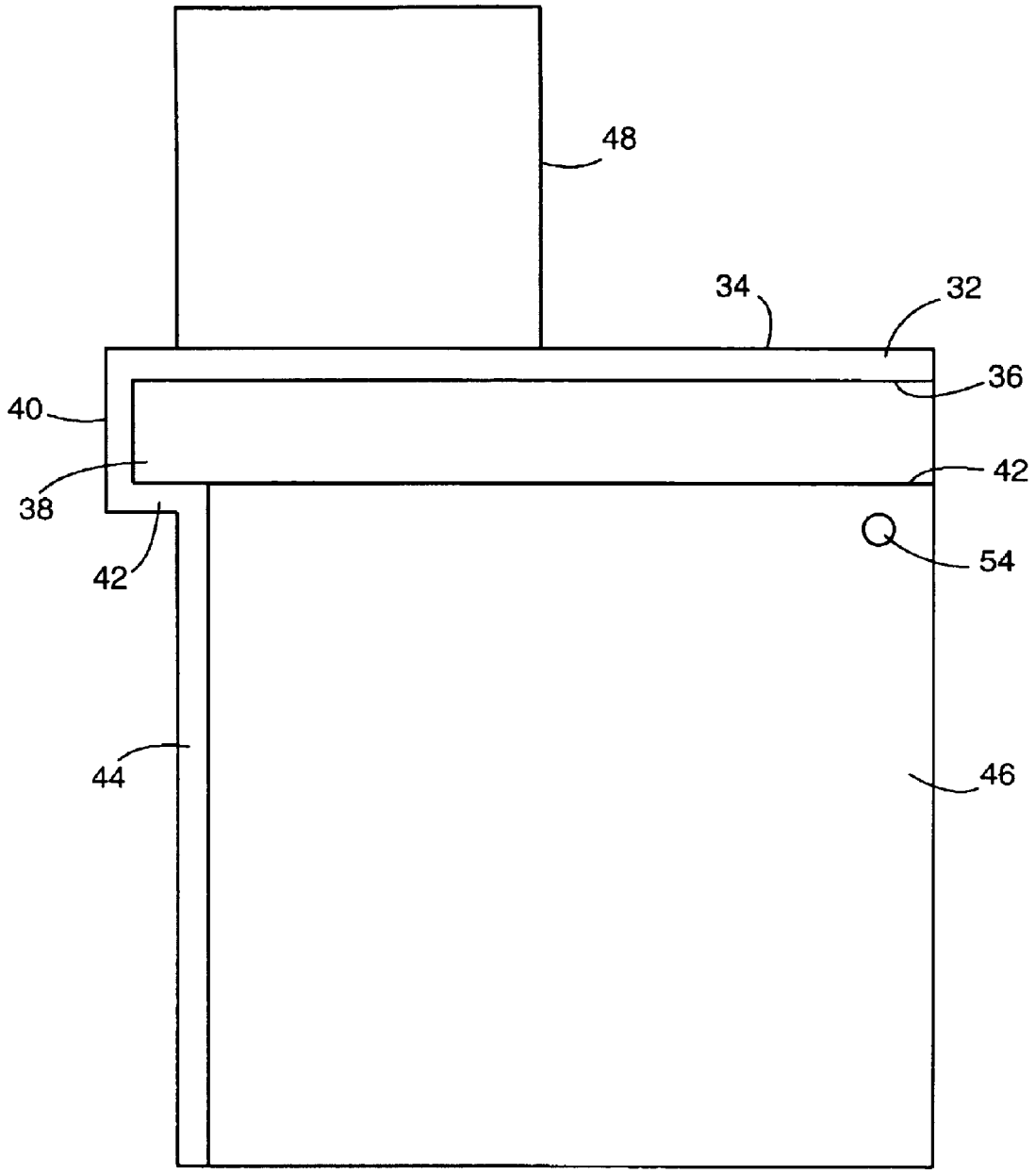
FIG. 3 is a side view of the temporary stairway rail and baluster support of FIG. 2 from view "A"
Figure 4:
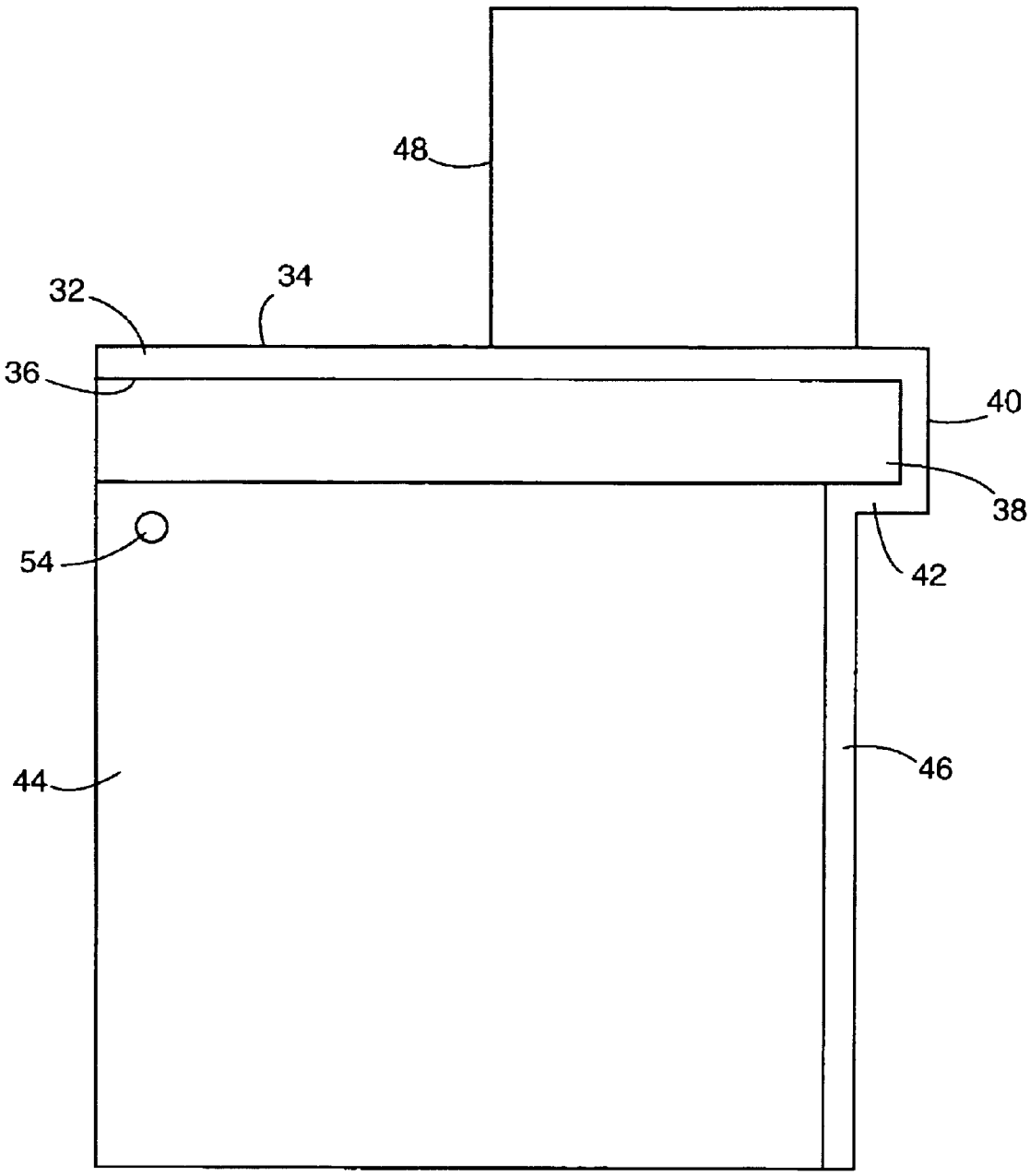
FIG. 4 is a side view of the temporary stairway rail and baluster support of FIG. 2 from view "B"

FIG. 2 is a top view of a temporary stairway rail support 30 of the present invention, and FIGS. 3 and 4 are side views of the stairway rail support from views "A" and "B" respectively. The stairway rail support has a planar base member 32 having an upper surface 34 and a lower surface 36. Depending from two adjacent sides of the planar base member is an L-shaped channel 38 in rectangular cross section defined by vertical walls 40 and horizontal lip members 42 and dimensioned to slidably engage the corner nosing of the tread member 12 as it overlaps the riser 14 and the adjacent open stringer 16. Two adjacent planar vertical depending members 44 and 46 depend downwardly from the lip members 42 and are juxtaposed against the riser 14 and the adjacent open stringer 16.

There is formed on the upper surface 34 of planar base member 32 a tubular member 48 for the slidable receipt of a temporary newel post, temporary balusters or similar vertical support in either a round, square or other geometrical cross section. A temporary hand rail would then be secured to the temporary posts.

The temporary stairway support member 30 would be secured to the stairway in one of the following manners. Channel 38 could be dimensioned to frictionally engage the corner nosing of tread member 12 with sufficient friction so as to require no fasteners. Alternatively, the temporary rail support would further be secured by a plurality of fastening means secured through apertures 54 in the depending vertical L-shaped member defined by depending walls 44 and 46 juxtaposed the open stringer 16 and the riser member 14. These fastening means would be secured immediately under the lip member 42 under which is juxtaposed to the underside of the nosing. In this fashion, when the temporary stairway rail support is removed, these apertures or bores formed in the riser 14 and open stringer 16 under the nosing will be covered by the finished molding member 26 when installed.

In this fashion, the contractor can install a plurality of temporary stairway rail supports on an unfinished staircase to establish a temporary hand rail. The number of temporary stairway support members required would depend upon the run or the height of the stairway in question, i.e. one every eight feet on center between supports.

Figure 5:
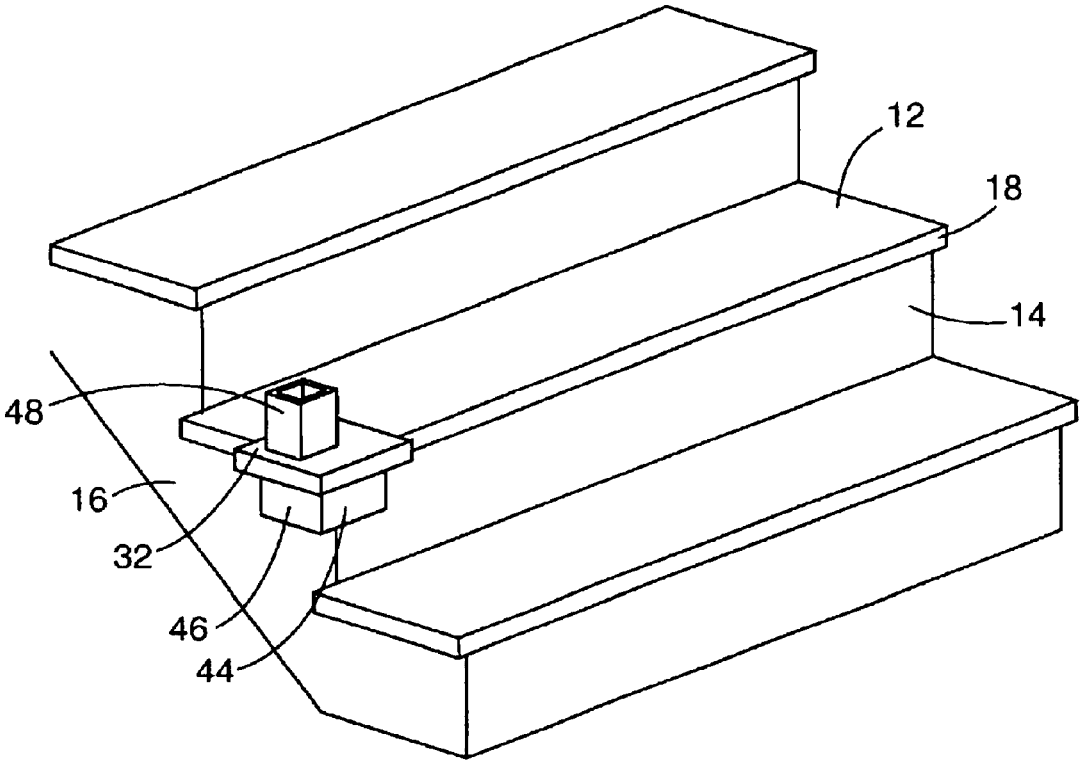
FIG. 5 is a perspective view of an installed temporary rail and baluster support of the present invention.

FIG. 5 is illustrative of the temporary stairway rail support member 30 positioned on a stairway tread, riser and open stringer.

The temporary stairway rail support member would preferably be made of metal or high impact plastic. Additionally, depending upon the tolerances to which it is manufactured, there may be no need to secure the rail support with a fastening means. If the tolerances are tight enough, the L-shaped channel will fit snugly on the corner of the tread member without the need for fasteners and may even be further secured without the need for fasteners by driving a wedge between the tread member of the stairs and the planar base member 32.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A temporary support means permitting installation of temporary newels and balusters for support of a temporary hand rail for stairs for use during the construction process, the stairs defined by a plurality of tread members, riser members and stringers, the temporary support means comprising:

a planar base member having an upper surface and a lower surface, said planar base member positioned on a tread of a set of stairs in a corner proximate to an intersection of an open stringer and riser, said planar base member having two adjacent stepped side walls depending therefrom, said planar base member and said first step of said side wall defining an L-shaped channel which is C-shaped in cross section frictionally engageable with a portion of nosing of said tread extending beyond said stringer and said riser, said second step of said stepped side walls juxtaposed said open stringer and said riser;

an upstanding tubular receiving member secured on said upper surface of said planar base member, said tubular receiving member positioned proximate to an end of said tread proximate said open stringer for slidable receipt of a temporary newel, temporary baluster, or temporary support post for support of a temporary support rail.

2. The temporary support member in accordance with claim 1 wherein said tubular receiving member is dimensioned in interior cross section to the exterior cross section of said temporary newel, said temporary baluster, or said temporary support post.

3. The temporary support means in accordance with claim 1 wherein said tubular receiving member is circular in cross section.

4. The temporary support means in accordance with claim 1 wherein said tubular member is rectangular in cross section.

5. The temporary support means in accordance with claim 1 wherein said temporary support means is maintained in position on said tread by friction.

6. The temporary support means in accordance with claim 1 wherein a securing means for said temporary support member includes a plurality of apertures for receipt of a plurality of threaded fasteners into said stringer and said riser beneath said nosing or said tread.

* * * * *